US005308010A

United States Patent [19]

Hakiel

[11] Patent Number: 5,308,010

[45] Date of Patent: May 3, 1994

[54] METHOD FOR ELIMINATING IMPERFECTIONS IN A WOUND WEB ROLL

[75] Inventor: Zbigniew Hakiel, Webster, N.Y.

[73] Assignee: Eastman Kodak Company, Rochester, N.Y.

[21] Appl. No.: 78,875

[22] Filed: Jun. 16, 1993

Related U.S. Application Data

[63] Continuation-in-part of Ser. No. 695,621, May 3, 1991, abandoned.

[51] Int. Cl.[5] ..... B65H 23/16; B65H 16/02

[52] U.S. Cl. ..... 242/75.3; 73/37.7; 226/3; 226/21; 242/67.3 R; 364/473

[58] Field of Search ..... 242/67.3 R, 75.1, 67.1 R, 242/67.2, 75.3, 66, 75.44; 226/20, 21, 3; 73/37.7; 364/473

[56] References Cited

U.S. PATENT DOCUMENTS

| | | | |
|---|---|---|---|
| 2,672,299 | 3/1954 | Jones | 242/57.1 |
| 3,667,283 | 6/1972 | Tarenaka et al. | 26/70 X |
| 4,453,659 | 6/1984 | Torpey | 226/20 |
| 4,980,846 | 12/1990 | Chapman | 364/563 X |

OTHER PUBLICATIONS

Altmann, Heinz C., "Formulas for Computing the Stresses in Center Wound Rolls," Tappi J., vol. 51, Apr. 1968.

Pfieffer, D. J., "Prediction of Roll Defects from Roll Structure Formulas," Tappi J., vol. 62, Oct. 1979, pp. 83-85.

Z. Hakiel, "Nonlinear model for wound roll stresses", *Tappi Journal*, May 1987, No. 5, pp. 113-117.

Press et al., "Numerical Recipes", *The Art of Scientific Computing*, 1986, Cambridge University Press, pp. 80-83.

*Primary Examiner*—Daniel P. Stodola
*Assistant Examiner*—John F. Rollins
*Attorney, Agent, or Firm*—William T. French; Carl F. Ruoff

[57] ABSTRACT

In the winding of webs of plastic films on cores, defects in the web caused by hard streaks in the wound roll are avoided or reduced by a new method of control. In this method, measurements are made of elastic properties of the web and of the average widthwise thickness distribution of the web. From these values, from measured properties of the core, and from selected initial winding conditions, including web tension, edge thickness and web oscillation, a predicted value of the combined imperfection severity function is determined. This value is compared with a pre-established tolerance; if it is outside the tolerance, winding conditions are adjusted to minimize the predicted web defects.

3 Claims, 14 Drawing Sheets

7.5"
6.0"
RADIUS
3.8
3.0
2.5"
0
WIDTH
54"

METHOD FOR ELIMINATING IMPERFECTIONS IN A WOUND WEB ROLL

CROSS-REFERENCE TO RELATED APPLICATION

This application is a continuation-in-part of now abandoned co-pending U.S. patent application Ser. No. 695,621, filed May 3, 1991, entitled "Control of Web Winding".

FIELD OF INVENTION

This invention relates to the winding of plastic webs and, more particularly, to a method of controlling web winding to avoid or reduce the creation of defects in the web.

BACKGROUND

Plastic webs such as photographic film bases, that are made by continuous extrusion or melt casting, often exhibit widthwise thickness variations (distribution of thickness across the width of the web) which are persistent in the lengthwise direction. These thickness variations are sometimes called gauge bands or thick/thin streaks. When webs having such gauge bands are wound into rolls, hardstreaks (also called ridges) can form in the winding roll. Hardstreaks are annular bands in the winding roll that are parallel to the sidewall of the roll. Where hardstreaks occur, the diameter of the winding roll is increased, and the pressure between layers in the wound roll is concentrated in this area. Hardstreaks are objectionable because they can lead to web imperfections including: distortions, pressure damage to sensitive coatings and adhesion or blocking of adjacent layers or laps in the wound roll.

To minimize the effect of such thickness variations, both edges of the web can be thickened through an embossing or knurling process and/or the web can be oscillated laterally during winding. Knurling creates artificially thickened areas at the edges of the web which, upon winding, create intentional hardstreaks at the edges. By creating these artificial hardstreaks at the edges in the nonusable portions of the web, a substantial part of the winding tension is used up and the effective tension in the middle portion of the web is significantly reduced, thereby reducing the severity of any hardstreaks which may form in the usable middle part of the web.

Oscillation, as in U.S. Pat. Nos. 2,672,299 and 4,453,659, offsets any thickened portions of the web to reduce the build up of thickness in a particular lateral portion of the wound roll. Although oscillation (also called "wiggle-winding" and "stagger winding") can reduce the development of hardstreaks in the wound web, it can also cause an undesirable amount of edge waste if the oscillation amplitude is large. On the other hand, if the oscillation amplitude is not sufficiently great, the gauge bands in the web are not offset enough to prevent or reduce the formation of hardstreaks.

Although thickening the edges can reduce the hardstreak problem, if they are too thick, i.e., if the "knurl height" is too great, other problems are caused. For example, if the edges are too thick, the web will be supported solely at the thick edges, and buckling will occur in middle of the roll. Also, if all of the roll tension is carried at the edges of the web, the high pressure at the thickened edges can result in "telescoping" or lateral shifting of laps of the roll because of instability in the widthwise direction. Therefore, to reduce the hardstreak problem without creating other problems it is necessary to determine an optimum edge thickness or knurl height for the web.

Similar considerations apply to the tension in the web during winding. Although lowering of tension can reduce hardstreaks, other problems occur if the tension is too low. In particular, at excessively low tension a slippage between layers occurs, a problem known in the art as cinching. Likewise, excessively low tension can cause telescoping or roll shifting.

The described problems can occur in the winding of a wide range of plastic web sizes. The problems are especially serious, however, in the winding of wide plastic webs, e.g., 40 to 80 inches in width, to form large rolls, e.g., of 1.5 to 5 feet in diameter, and especially when the web comprises a thermoplastic film base or support that is coated with one or more photographically sensitive layers and other layers. Such webs are especially susceptible to hardstreak formation, and the waste created by hardstreaks is especially costly. As a consequence, a need exists for a method for controlling the winding of plastic webs so that the severity of hardstreaks in the wound web can be minimized without creating other problems.

BRIEF SUMMARY OF THE INVENTION

In accordance with the present invention a method is provided for controlling web winding which reduces or eliminates the mentioned problems, especially for wide webs and rolls of large diameter as indicated above. The novel method includes steps which are carried out by automatic data processing equipment employing an analytical model that predicts winding imperfections and facilitates selection of optimum winding conditions to minimize the severity of winding imperfections. Variables which are factors in the model include thickness variations of the web, winding conditions, dimensions and stiffness of the core, and elastic properties of the web.

The method of the invention comprises:

(a) measuring properties of a plastic web to be wound on a core including:

(1) modulus of elasticity of the web plastic, (2) stackwise compression modulus of the web, (3) stackwise compression modulus of the thickened edges, (4) Poisson's ratio of the web plastic, and (5) stress relaxation modulus of the web plastic;

(b) measuring properties of the core, including (1) core modulus, and (2) core diameter;

(c) selecting individual winding conditions, including (1) initial web tension, (2) initial edge thickness, and (3) initial web oscillation;

(d) iteratively measuring widthwise variations of said web at lengthwise locations on the web;

(e) determining the average widthwise thickness distribution for the web by averaging in the lengthwise direction the measured widthwise thickness variations;

(f) determining the combined imperfection severity function from the measurement of said properties of the web and the core, said initial winding conditions, and said average widthwise thickness distribution by means of the following relationship $$\Phi = \sum_{k=1}^{4} c_k \phi_k$$

wherein $\Phi$ is the combined imperfection severity function, $\phi_k$ is the kth individual imperfection severity function, and $c_k$ is the weight factor for the kth individual imperfection severity function;

(g) comparing the value of the combined imperfection severity function so determined with a pre-established tolerance to determine whether said value of the combined imperfection severity function is within or outside the tolerance;

(h) when said value of the combined imperfection severity function is within said tolerance, winding the web on the core at said initial winding conditions;

(i) when said value of the combined imperfection severity function is outside said tolerance, winding the web on the core under winding conditions corrected by adjustment of at least one of the conditions of web tension, edge thickness, and web oscillation to cause optimization of the value of said combined imperfection severity function.

THE DRAWINGS

Figure 3A:
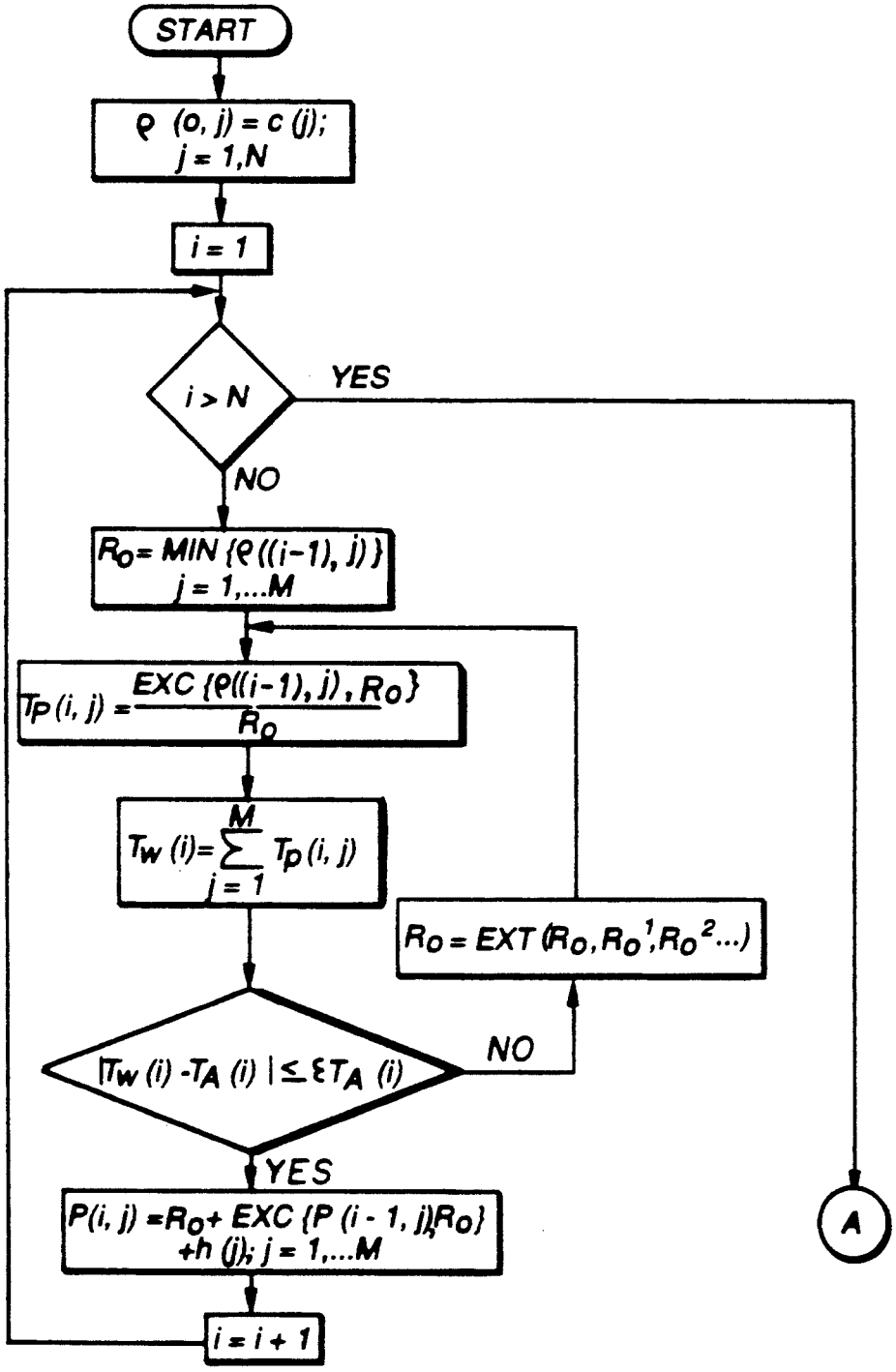
FIG. 3A is the first part of a flow chart of the analytical model for predicting web imperfections.
Figure 3B:
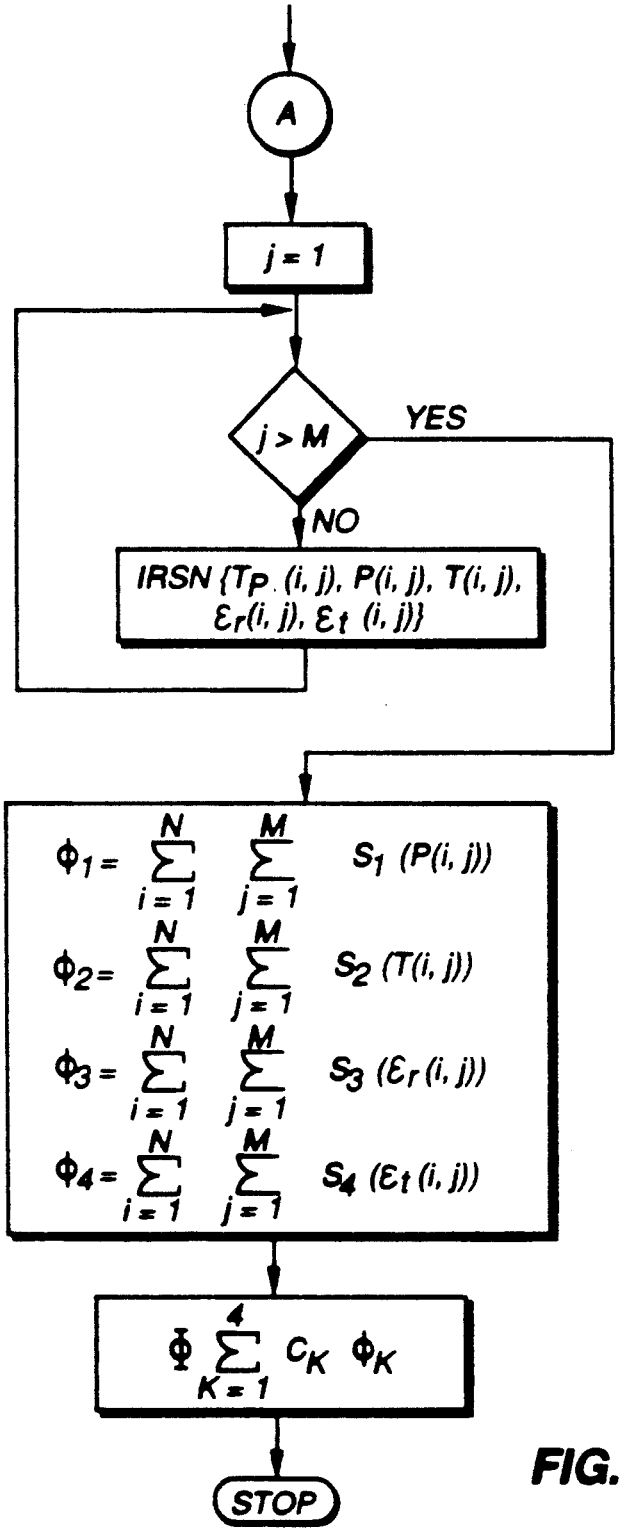
Figure 3C:
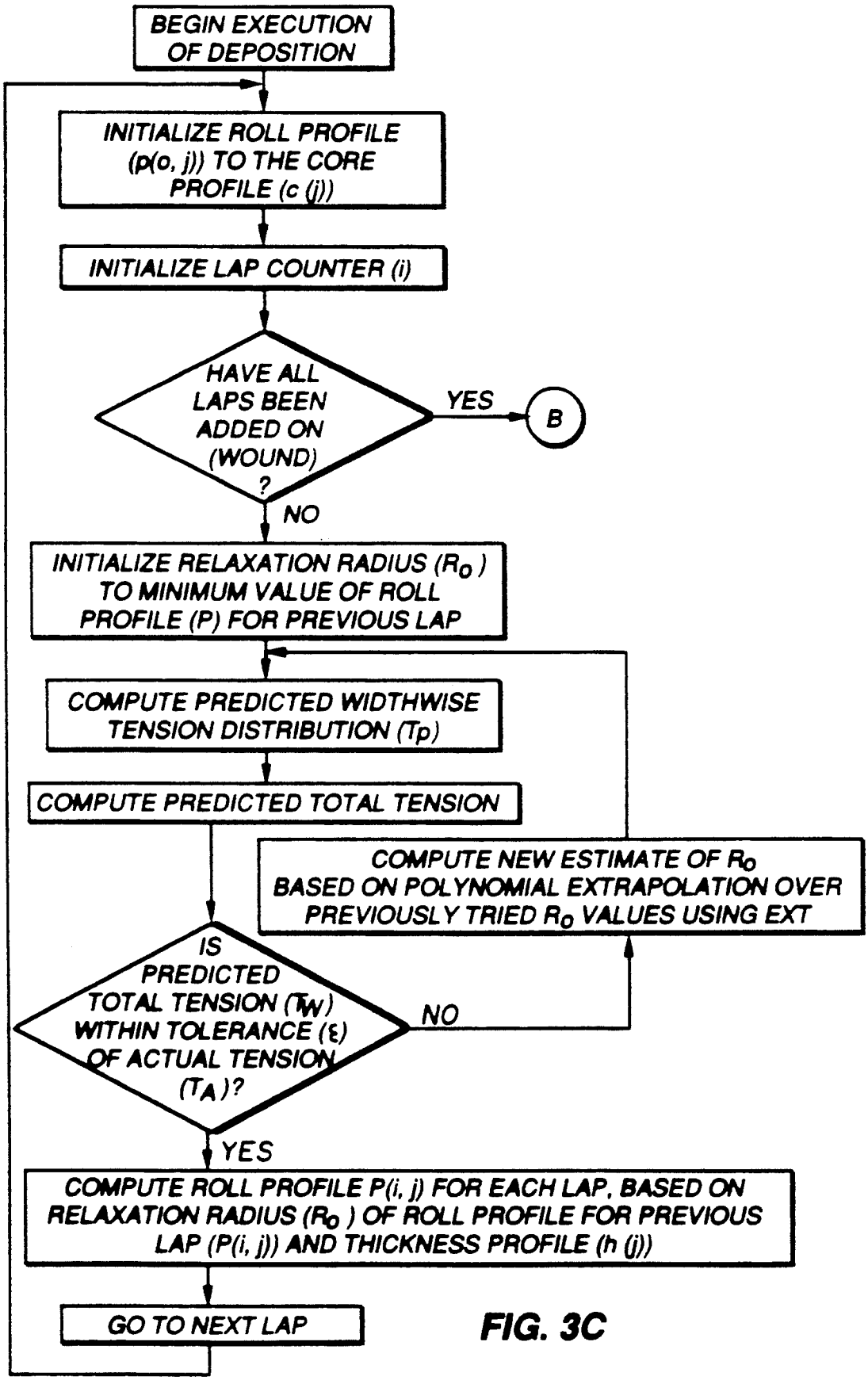
Figure 3D:
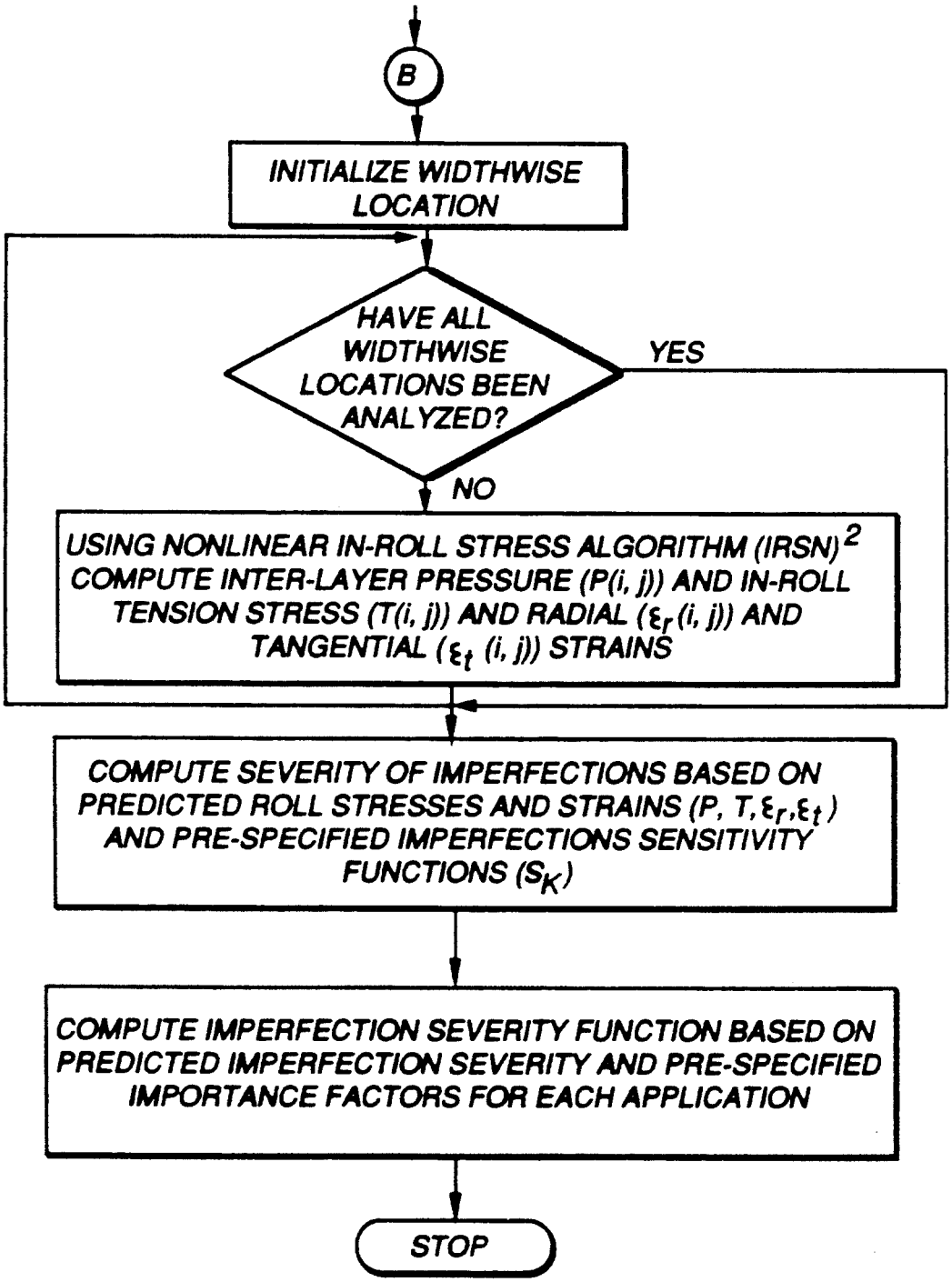
Figure 3E:
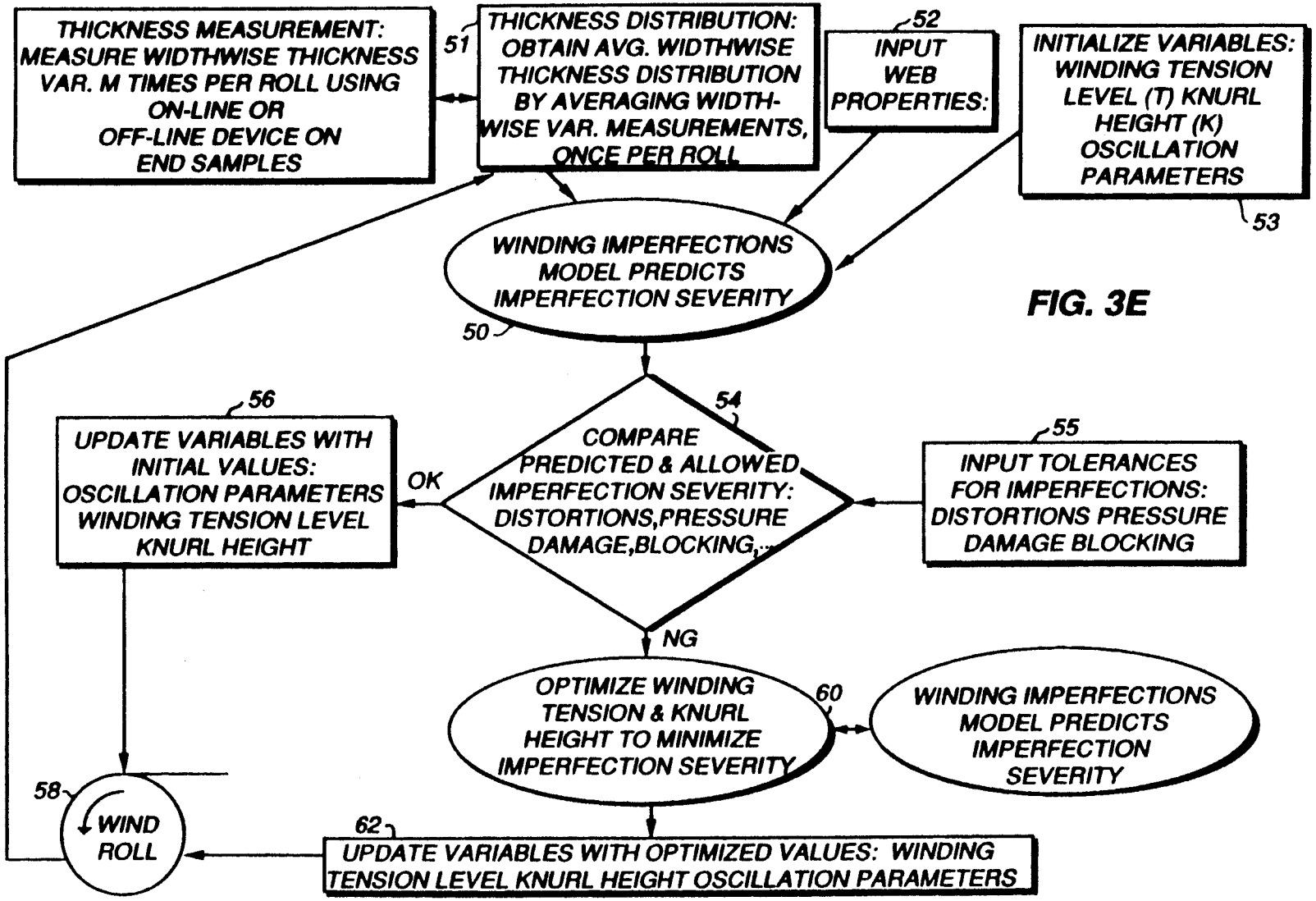
Figure 4:
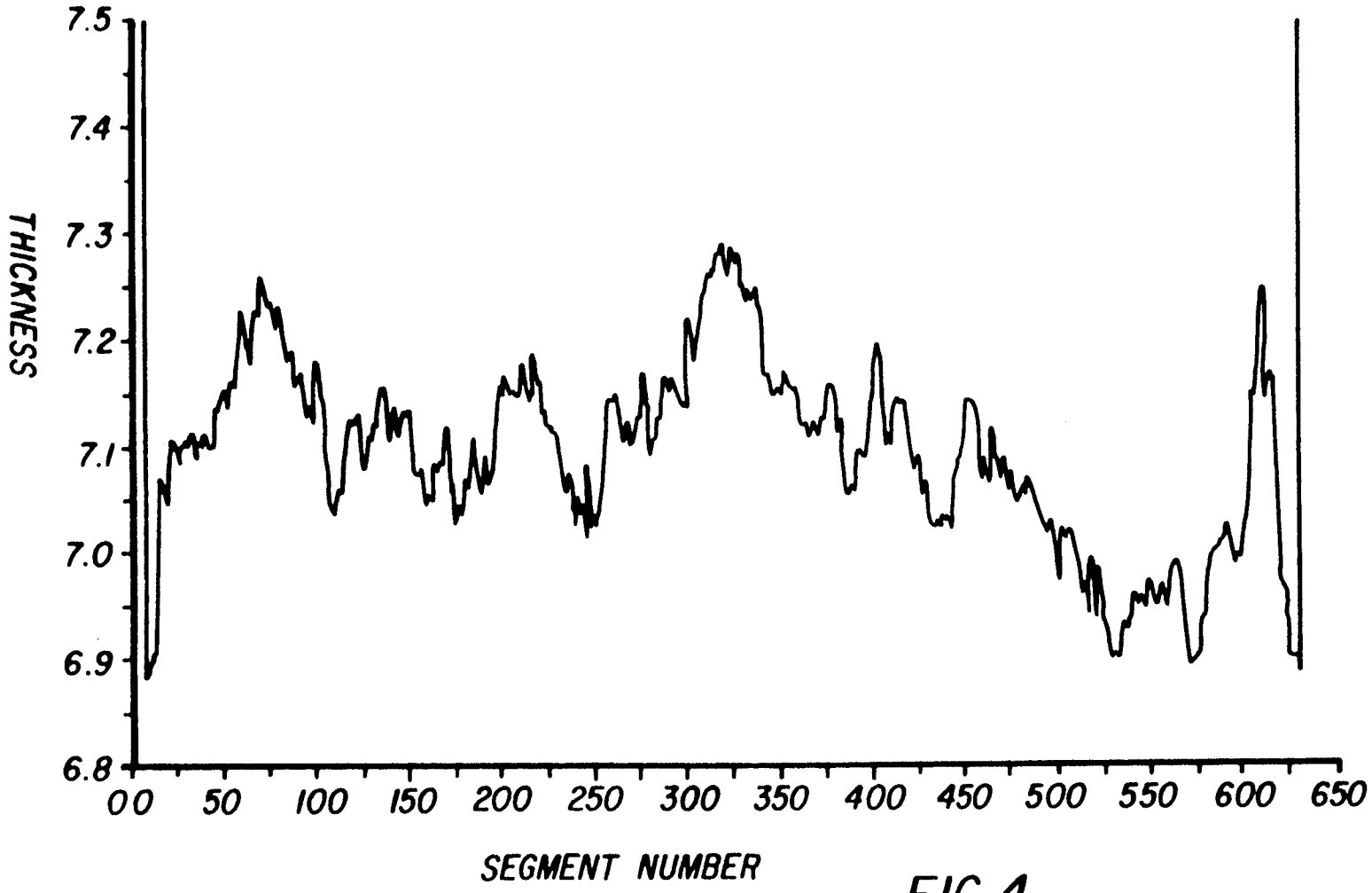

FIG. 3B a continuation and completion of the flow chart of FIG. 3A;

FIG. 3C is the first part of a word description flow chart corresponding to FIG. 3A, which explains the programming of the model;

FIG. 3D is a continuation and completion of the word description flow chart and corresponds to FIG. 3B;

FIG. 3E is a schematic diagram of the method of the invention which uses the analytical model of FIGS. 3A–3D;

FIG. 4 is a plot showing a widthwise thickness distribution of a film web; and FIGS. 5, 6, 7 and 8 are predicted plots of the widthwise radius variations for a roll of film wound under three different combinations of winding conditions at different stages in the winding of the roll.

Figure 9:
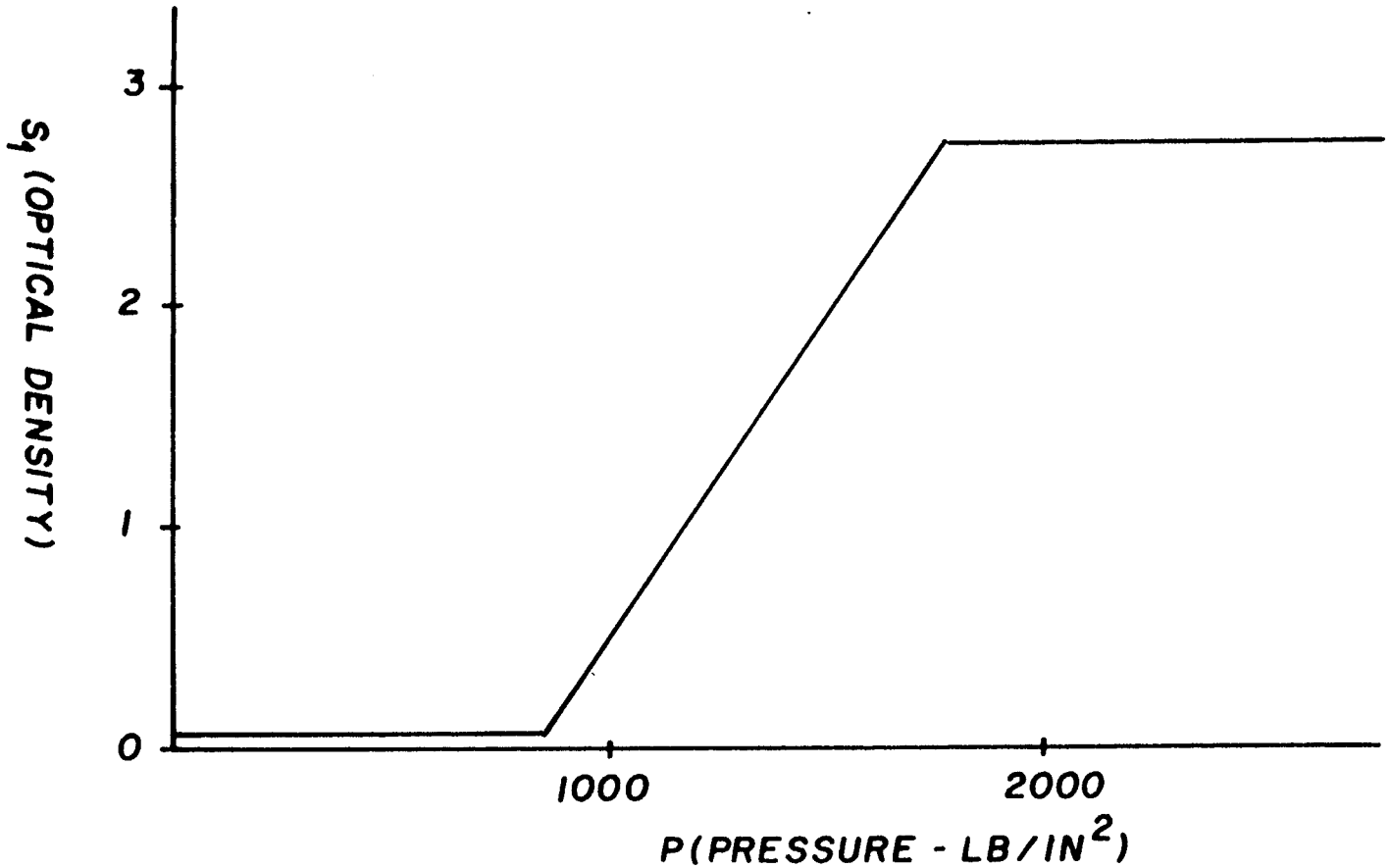

FIG. 9 is a plot of the sensitivity function for a pressure-induced imperfection in a photographic film.

Figure 10:
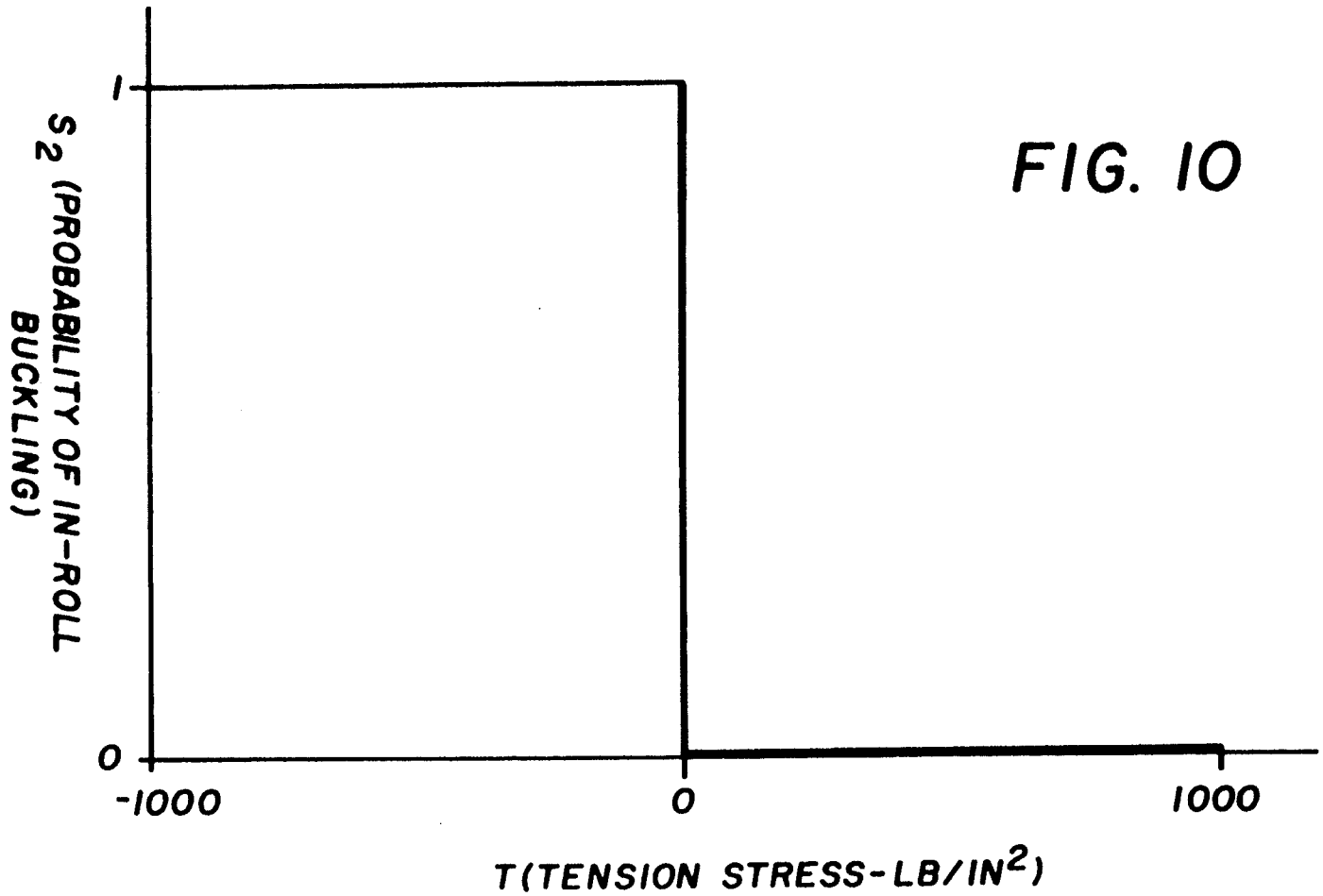

FIG. 10 is a plot of the sensitivity function for a buckling imperfection in a photographic film.

DETAILED DESCRIPTION OF THE INVENTION

Definitions (a) "modulus of elasticity of the web plastic" means the ratio of stress to the corresponding strain (lb/in$^2$).

(b) "stackwise compression modulus of the web" means the modulus of a stack of sheets of the web material in compression (lb/in$^2$).

(c) "stackwise compression modulus of the thickened edges" means the modulus of a stack of the knurled or thickened edges (lb/in$^2$).

(d) "Poisson's ratio of the web plastic" means the ratio of the contraction of the lateral dimensions of the sample to the strain or unit elongation (elongation per unit of length). This ratio, c/s, is constant for a given plastic material within the elastic limit.

(e) "stress relaxation modulus of the web plastic" means the time-dependent value of stress divided by the constant strain for a stretched sample of the web (lb/in$^2$).

In the method of the present invention, winding imperfections caused by lengthwise persistent widthwise thickness variations are avoided or reduced by the use of an analytical model, which is depicted in a flow chart in FIGS. 3A and 3B and further elucidated in a word description flow chart in FIGS. 3C and 3D. Definitions of the terms used in FIGS. 3A–3D are listed in Table I below.

TABLE I

| Definitions: | |
|---|---|
| $\rho$ (i, j) | widthwise roll radius distribution, where i designates the lap number within the roll, which can vary between 0 for the core and N at the outside of the roll and j designates widthwise position. |
| $R_o$ | relaxation radius, which is the roll radius at which the tension in the length direction is zero. |
| c (j) | widthwise radius distribution of the core where j denotes widthwise position. |
| N | number of laps in roll. |
| M | number of widthwise locations. |
| $\delta$ | width increment (web width divided by M). |
| MIN [ ] | minimum value in a vector of values. |
| EXC [x, y] | x − y for x > y.<br>0 otherwise |
| h (j) | average widthwise thickness profile, where j designates the widthwise location. |
| $\phi_1$ | severity function for pressure-induced winding imperfections. |
| $S_1$ | sensitivity function for pressure induced winding imperfections. |
| $\phi_2$ | same as $\phi_1$ for tension. |
| $S_2$ | same as $S_1$ for tension. |
| $\phi_3$ | same as $\phi_1$ for radial strain. |
| $S_3$ | same as $S_1$ for radial strain. |
| $\phi_4$ | same as $\phi_1$ for tangential strain. |
| $S_4$ | same as $S_1$ for tangential strain. |
| $\Phi$ | combined imperfection severity function. |
| $c_k$ | weight factor for kth imperfection. |
| $\epsilon$ | tension tolerance. |

In addition to the definitions included in Table I, the expression EXT refers to an algorithm for polynomial extrapolation, as described in Press et al., *Numerical Recipes, The Art of Scientific Computing*, 1986, Cambridge University Press, pages 80–83, the disclosures of which are incorporated herein by reference.

The expression IRSN represents a non-linear algorithm for predicting stresses in wound rolls, as described in Z. Hakiel, "Nonlinear model for wound roll stresses", *Tappi Journal*. May 1987, No. 5, pages 113–117, the disclosures of which are incorporated herein by reference. This algorithm utilizes properties of the web and characteristics of the core, together with winding conditions such as winding tension, to calculate predicted values of interlayer pressure P, inroll tension stress T, radial strain $\epsilon_r$, and tangential strain $\epsilon_t$. The properties of the web required as input include:

modulus of elasticity of the web plastic, determined by the method described in ANSI/ASTM standard D882-79; stackwise compression modulus, determined by the procedure described in J. Pfeiffer, *Tappi Journal.* April 1981, No. 4, pages 105–106; Poisson's ratio of the web plastic, determined by the method of ASTM standard E132-61 (1965).

By means of the analytical model described in FIGS. 3A–3D, the severity functions $\phi_1$ for pressure-induced winding imperfections, $\phi_2$ for tension-induced imperfections, $\phi_3$ for radial straininduced imperfections, and $\phi_4$ for tangential straininduced imperfections are determined:

$$\phi_1 = \sum_{i=1}^{N} \sum_{j=1}^{M} S_1 P(i,j)$$

$$\phi_2 = \sum_{i=1}^{N} \sum_{j=1}^{M} S_2 T(i,j)$$

$$\phi_3 = \sum_{i=1}^{N} \sum_{j=1}^{M} S_3 \epsilon_r(i,j)$$

$$\phi_4 = \sum_{i=1}^{N} \sum_{j=1}^{M} S_4 \epsilon_t(i,j)$$

wherein the terms are as defined in Table I. the sensitivity functions $S_1$, $S_2$, $S_3$, and $S_4$ are pre-established response relationships that can be determined by either empirical measurements or theoretical considerations.

The above-described individual severity functions are subjected to an optimization routine, such as linear programming, to obtain a minimum predicted value of the combined severity function. Linear programming routines are well known, as exemplified by the disclosure in Chapter 10, pages 312-326, of the aforementioned *Numerical Recipes, The Art of Scientific Computing.*

The combined imperfection severity function $\Phi$ is defined by the relationship $$\Phi = \sum_{k=1}^{4} c_k \phi_k$$

wherein $\phi_k$ is the kth individual imperfection severity function, and $c_k$ is the weight factor for the kth individual imperfection severity function. The value of an individual weight factor is based on a determination of the relative economic importance of the corresponding imperfection.

A digital computer programmed in accordance with the analytical model described in FIGS. A and 3B can be employed to determine the optimum winding conditions for minimizing winding imperfections. One step in the computerized method is to obtain multiple measurements of widthwise thickness variability of the web, either offline or preferably online with a noncontacting device, and averaging these measurements in the lengthwise direction to obtain an average widthwise thickness distribution.

The aforementioned web properties and core characteristics, including length and diameter dimensions are employed as input for the analytical model, together with starting values for the winding conditions, including, for example, winding tension, knurl or edge thickness of the web, and web oscillation conditions. The selection of these starting values is usually based on values determined for a previously wound roll.

Prior to winding the roll, the model is executed using the above described information, and a predicted value for the combined imperfection severity function is computed. This predicted value for the imperfection severity function is compared with a pre-established tolerance for this function. If the severity is acceptable, i.e., within the tolerance, the initial winding conditions are used to wind the roll and the process is repeated for the next roll. However, if the predicted value for the imperfection severity function falls outside of the tolerance range, the aforementioned optimization routine is invoked to minimize the value of the function. The routine evaluates values for the combined imperfection severity function for various values of winding tension, knurl height, and web oscillation conditions in order to find the optimum combination that results in the minimum value of the imperfection severity function. Once such minimum is found, the corresponding values of winding tension, knurl height and web oscillation conditions are used to wind the roll. The original starting values for the winding conditions are updated with the new values, and the process is repeated for the next roll.

To illustrate how this new method can be applied to a particular web winding operation, reference will be made to the drawings.

Figure 1:
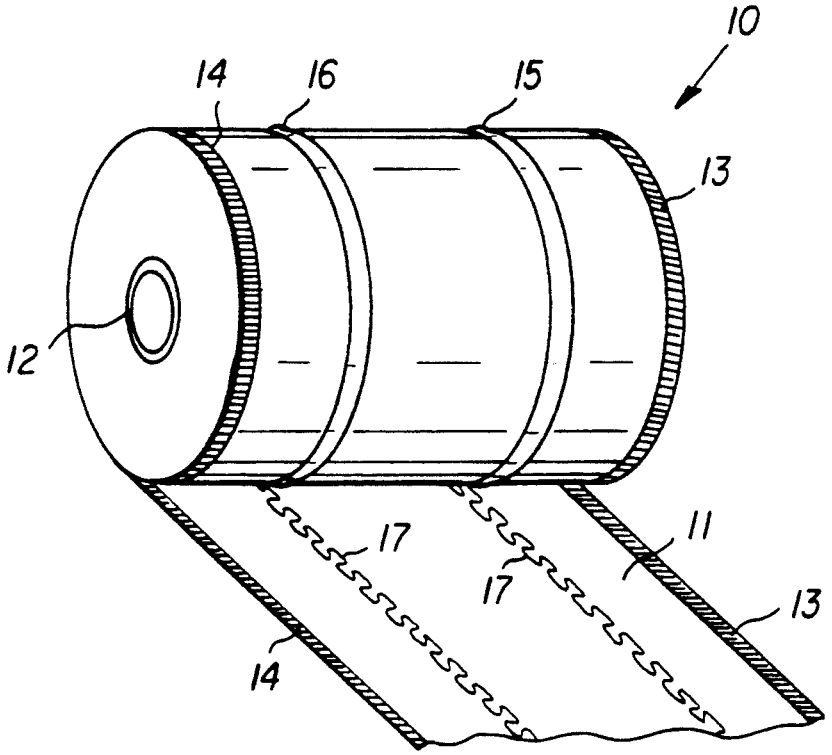
FIG. 1 is a diagrammatic view in perspective of a wound roll of a plastic film web having knurled edges and exhibiting hard streaks in the roll and distortions in the film surface.

As shown in FIG. 1, a roll 10 of a polyester plastic film 11 is wound on a metal or plastic core 12. Extending along each edge of the film 11 are thickened areas or knurls 13 and 14. FIG. 1 represents a roll in which, because of the winding conditions, defects have been created in the roll and in the surface of the web. The roll defects are the hardstreaks or gauge bands 15 and 16. These are annular portions of the roll of substantially greater diameter than the rest of the roll.

A result of the formation of the hardstreaks 15 and 16 is that the web in the area of the hardstreaks is under excessive radial pressure. As FIG. 1 shows, this results in web defects. These are depicted in FIG. 1 as distortions 17, which can take the form of a line of intermittent, closely spaced dimples, puckers or dents in the surface of film 11. By the method of the present invention the creation of such defects is reduced or eliminated.

Figure 2:
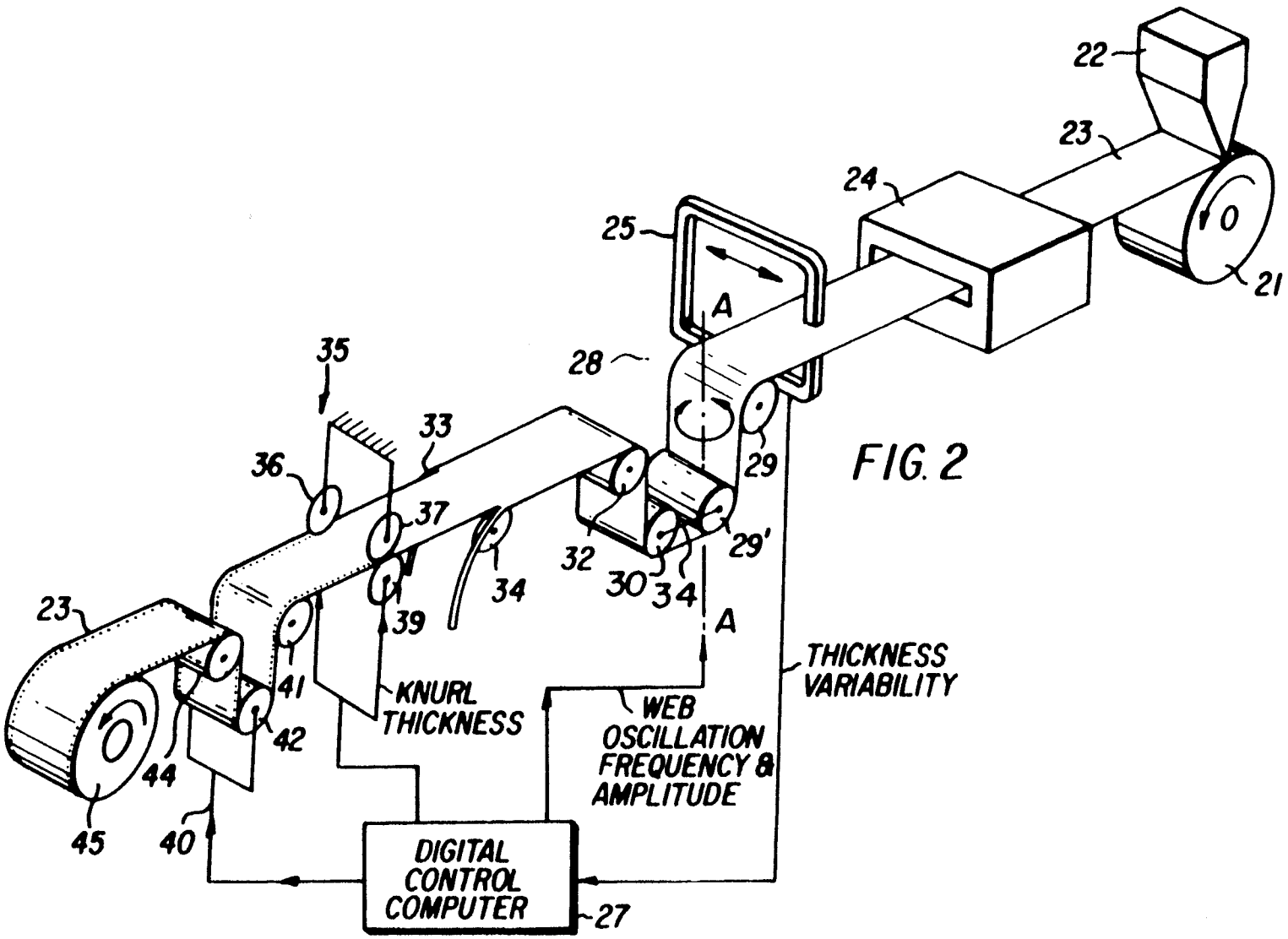
FIG. 2 is a diagrammatic view of a line for extruding and winding a plastic film web, with controls of the winding conditions in accordance with the invention.

FIG. 2 illustrates a film casting line in which the method of the invention can be carried out. The method is schematically presented in FIG. 3E. Roll 21 of the line is a casting or quenching roll on which a polymer film is melt cast by means of an extrusion die 22. Molten polymer, e.g., film-forming poly(ethylene terephthalate), is extruded via die 22 onto the cooled, rotating roll 21, where it solidifies to form the film 23. The latter then passes through one or more selected processing stations which are represented schematically by block 24. These can include any of a number of processes such as film drafting and tentering, heat setting, coating of the film with photographic layers or the like, and drying.

After the processing steps of block 24, where the web achieves its intended thickness prior to winding, the film is subjected to thickness measurements. Although in the method of the invention the thickness measurements can also be made off line on samples of the film, FIG. 2 depicts the embodiment in which online thickness measurements are made.

FIG. 2 shows the widthwise thickness measurements of the film being made continuously by traversing the measuring head across the web as the web passes through the instrument 25. The latter can be any of a number of contacting or non-contacting instruments for measuring film thicknesses. A preferred instrument is the Beta-Gauge Basis Weight Sensor of Measurex Corporation, Cupertino, Calif. 95014, Model 2201/2202. This instrument measures the film thickness by sensing variations in Beta-ray transmission by the moving web. The lateral measurements are averaged in the lengthwise direction by the measuring instrument to obtain an average thickness distribution of the web. The values for the average thickness measurement, with other data, are input to the digital control computer 27 as shown in FIG. 2, which computer is programmed in accordance with FIGS. 3A-3D.

In the method of the invention, at least one of the winding conditions is adjusted or controlled to levels which avoid the formation of hardstreaks in the wound roll or reduce their severity to within acceptable tolerances. These adjustable winding conditions include the tension that is maintained in the web 23 during winding, the height of the thickened edges or knurls that are formed along the edges of the web, and the extent to which the web is oscillated as it travels toward the winding roll. See FIG. 3E.

In FIG. 2 the first of the means for adjusting the web winding conditions is web oscillator or steering frame guider 28, which is illustrated schematically. The web 23 first passes over an entry deflector roller 29 of guider 28, and passes vertically to a web entry roller 29' then horizontally to web exit roller 30. The rollers 29' and 30 are mounted in a horizontally oriented guide frame 34, which is mounted for reciprocating pivotal movement in a horizontal plane on a vertical pivot axis A—A. Leaving exit roller 30, the web passes over exit deflector roller 32 toward subsequent positions in the line.

The guide frame 34 can be reciprocally pivoted on axis A—A by conventional means, not shown in the drawing, to oscillate the path of the web as it moves toward the winding roll of the line. This is one effective means known in the art for laterally offsetting thickened portions of the web as it is wound and thus reducing the tendency toward formation of hardstreaks in the wound roll. Because of the lateral movement imparted to the moving web by this oscillation procedure, it is also referred to as "wiggle winding" and "stagger winding." Selection of optimum oscillation parameters, i.e., amplitude and frequency, is desirable because if the film path is not offset sufficiently the hardstreak problem is not sufficiently reduced but if the offset is too great the amount of edge waste that must be trimmed from the web is excessive.

One suitable apparatus for web oscillation is the web guiding apparatus disclosed in U.S. Pat. No. 4,453,659, incorporated herein by reference. While the patent describes the use of the apparatus to correct web deviations, it can also be used to cause sinusoidal lateral oscillation of the web. Another useful apparatus is disclosed in U.S. Pat. No. 2,672,299, incorporated herein by reference.

After leaving the guider 28, the edges of the web 23 are trimmed by the edge slitters 33 and 34 to remove edge waste caused by oscillation of the film and to form a straight edge.

Following the slitters 33 and 34, the web passes through another means for controlling winding conditions, namely, the knurling apparatus 35. This means, shown schematically in FIG. 2, includes two fixed wheels 36 and 37 positioned above web 23 and two adjustable wheels 39 positioned below the web. The web, optionally, is heated, e.g., ultrasonically as in U.S. Pat. No. 4,247,273 (incorporated herein by reference) or otherwise, just before or during contact with the wheels. The wheels have patterned surfaces which, in known manner, are adapted to form thickened and knurled areas along the edges of the web. The edge thickness or knurl height depends upon the pressure applied by the adjustable wheels. This pressure is controlled in accordance with the invention by the control computer 27 to provide a knurl height that is sufficient to reduce hardstreak formation but not so great as to cause the problems which are characteristic of excessively thickened edges.

After the knurling operation, the web passes to a tension-controlling means 40. This comprises a fixed entry roller 41, a float roller 42 and a fixed exit roller 43. The force exerted by roller 42 to increase or decrease the web tension is also controlled in accordance with the invention by the control computer 27.

After passing the tension-controlling means, the web 23 is wound on the take-up roll or winder 45. Upon reaching this position the tension on the web has been controlled, the edge thickness has been controlled, and the horizontal oscillation of the moving web has been controlled. These three conditions are controlled by the control computer 27. It determines from the thickness measurement by instrument 25 and from the input data as to film properties and defect tolerances, the conditions required to wind the web without exceeding defect tolerances.

Although FIG. 2 shows the control of the three winding conditions, web tension, edge thickness, and the oscillation parameters of amplitude and frequency, it should be understood that it is not always necessary to adjust all three of these conditions. In particular, if defects can be sufficiently reduced by adjusting only the edge thickness and the web tension, it may be preferred to omit the web oscillator, since this operation causes edge waste. However, if lengthwise persistent widthwise thickness variations are so great that defects cannot be sufficiently reduced without using web oscillation, the method of the invention can include the control of that operation as has been described.

The output of the digital computer 27 which controls the steering frame guider 28 is ported through an electromechanical drive, e.g., a servo motor. The output of the computer 27 which controls web tension is ported to a pneumatic actuator in the tension float roller 42. Conventional digital to analog interfaces can provide the necessary output porting.

FIG. 3E of the drawing illustrates how the analytical model for predicting web imperfections is used in the method of the invention. The inputs to the model 50 are the average thickness profile 51, the web properties 52 and the initial winding conditions 53. As previously indicated, the average thickness profile can be derived by off-line measurements of a portion of the web or by on-line measurements during winding of the web. The web properties are as previously defined. The initial winding conditions include the web tension, the edge thickness (knurl height), and the oscillation amplitude and frequency.

From these data, the control computer executes the model as in FIGS. 3A-3D and predicts the severity of web defects such as distortions, pressure damage to coated layers, and blocking or adhesion of successive laps of the roll. As indicated by decision block 54 of FIG. 3E, these predicted values are compared with the tolerances input as indicated by block 55. If the predictions are within tolerances (OK), the initial winding conditions input (block 53) are updated or corrected (block 56) and used to control the winding tension, edge thickness, and oscillation parameters for winding the roll 58, with the control means 40, 35, and 28 of FIG. 2

If the predictions exceed tolerances, an optimization routine (block 60) is executed, preferably using linear programming techniques as described above. This provides new values to update the winding conditions, as indicated by block 62, which are used in winding of the next roll to be produced. Thus, the measurements made for winding each roll are used to set the winding conditions for the next roll.

FIG. 4 of the drawing is a plot of the average thickness distribution for a poly(ethylene terephthalate) film of nominal 7-mil (0.007 in.) thickness. The plot is obtained by thickness measurements with a contacting off-line LVDT based profiler, but could have been obtained with a "Beta-Gauge" instrument as previously described. FIG. 4 plots the thickness in mils (0.001 in.) as the vertical axis against the widthwise locations. As the plot shows, at both edges the film is thicker than 7.5 mils, thus identifying the presence of knurled or thickened edges. At intermediate points across the web, the average thickness varies from a low of about 6.9 mils to a high of about 7.3 mils.

FIGS. 5, 6, 7, and 8 are predicted plots of roll diameters, the predictions being made by use of the analytical model of FIGS. 3A–3D.

The following tables list the characteristics of the web and roll (Table II) as well as winding tension and knurl height (Table III) for the four predicted cases depicted in the plots of FIGS. 58.

TABLE II

| | | |
|---|---|---|
| Web width | 54 | in. |
| Web thickness | 0.007 | in. |
| Knurl width | 0.5 | in. at each edge |
| Core diameter | 5 | in. |
| Roll diameter | 15 | in. |
| Elastic modulus of web | 660,000 | $lb/in^2$ |
| Poisson's ratio of web | 0.3 | |

TABLE III

| FIG. | Winding Tension (lb.) | Knurl Thickness (in.) |
|---|---|---|
| 5 | 200 | 0.0073 |
| 6 | 110 | 0.0073 |
| 7 | 200 | 0.0075 |
| 8 | 110 | 0.0075 |

Figure 5:
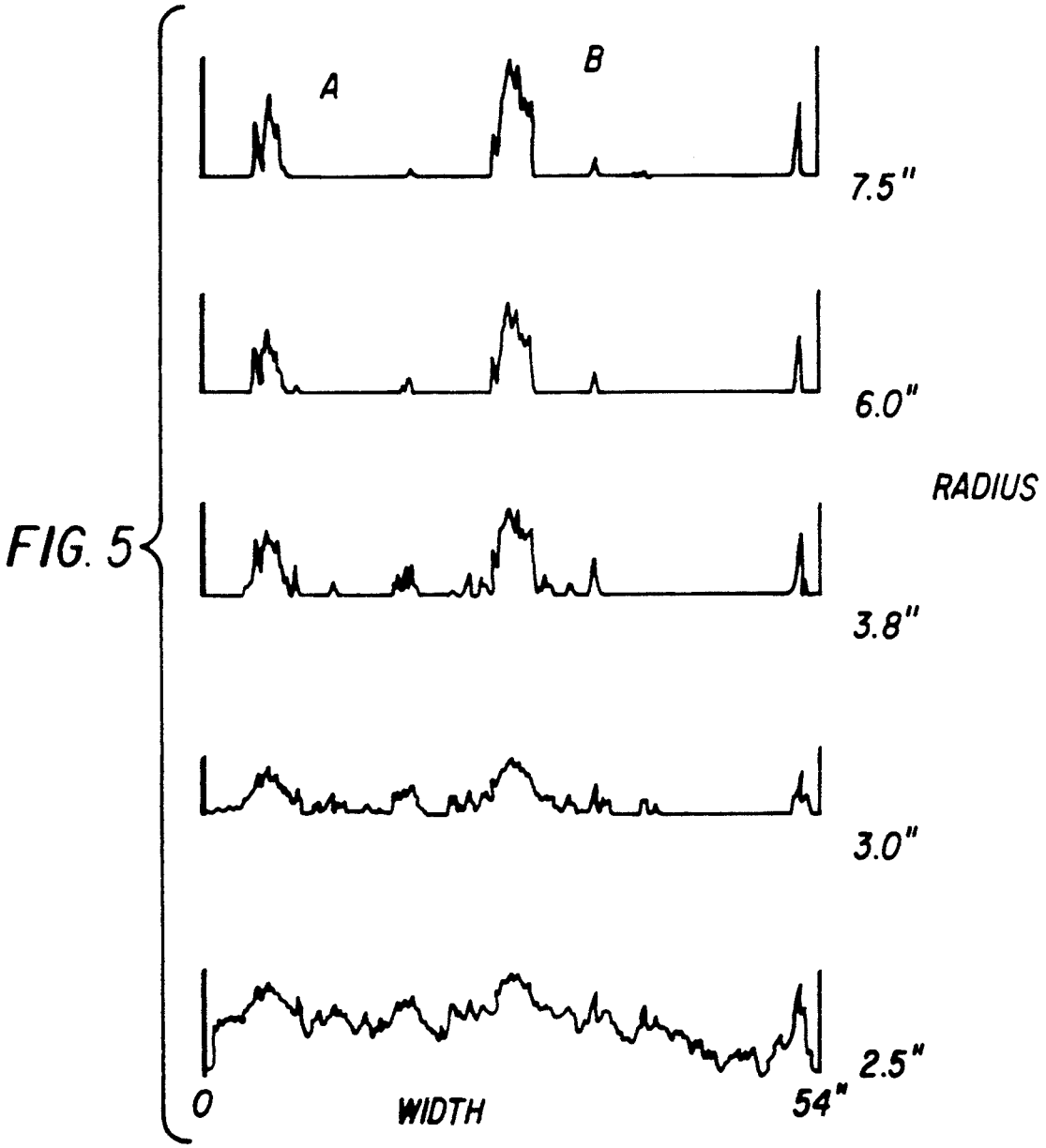

FIG. 5 shows the roll profile at successive roll radius during winding. Initially, at 2.5 in. radius the roll has a typically uneven profile, such as in FIG. 4. Then, as the roll is wound at a winding tension of 200 lb. and a knurl height of 0.0073 inch at each edge of the film, the roll surface progressively begins to develop hardstreaks. When the roll radius has reached 7.5 in. (the uppermost plot of FIG. 5), two severe hardstreaks A and B are apparent.

Figure 6:
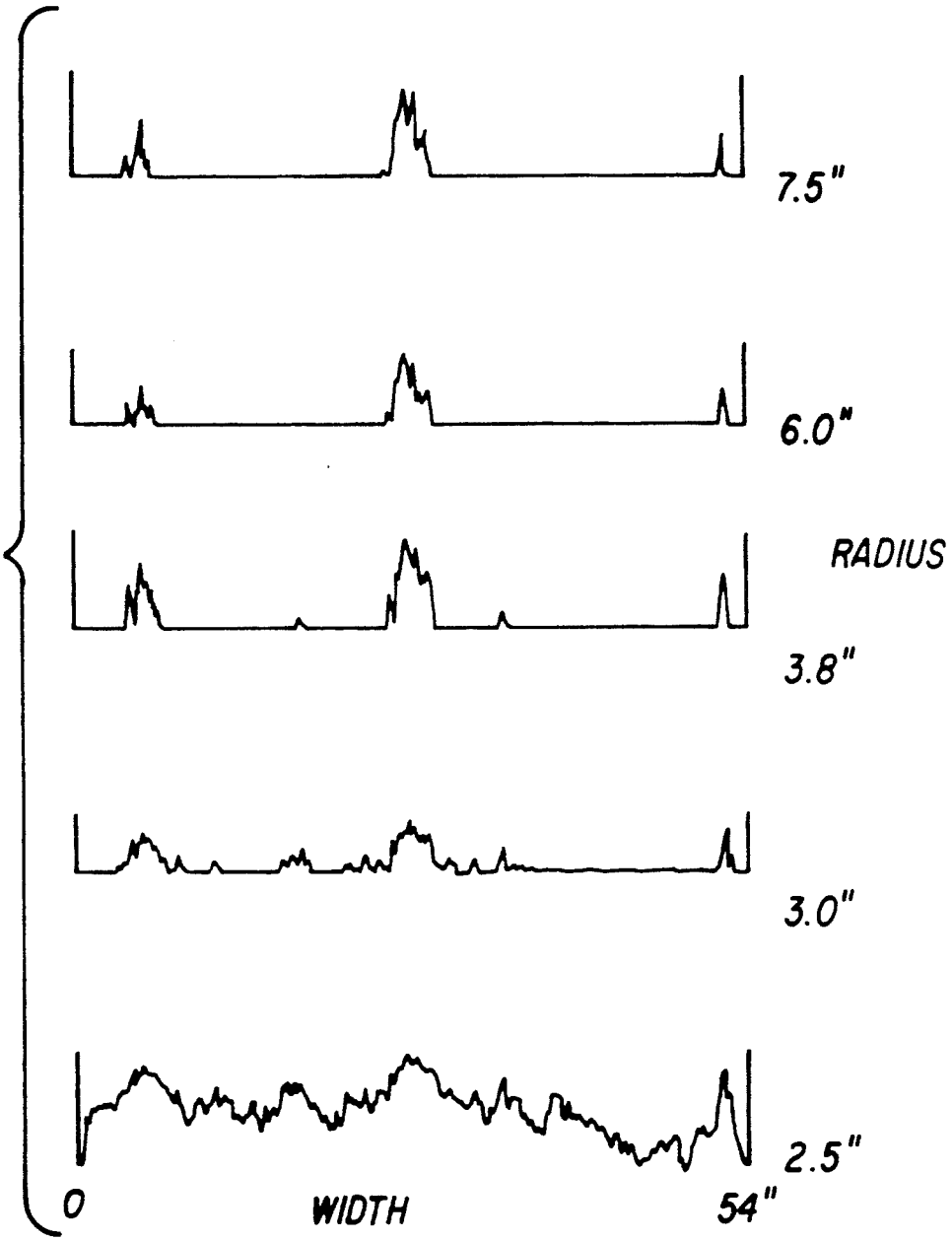
Figure 7:
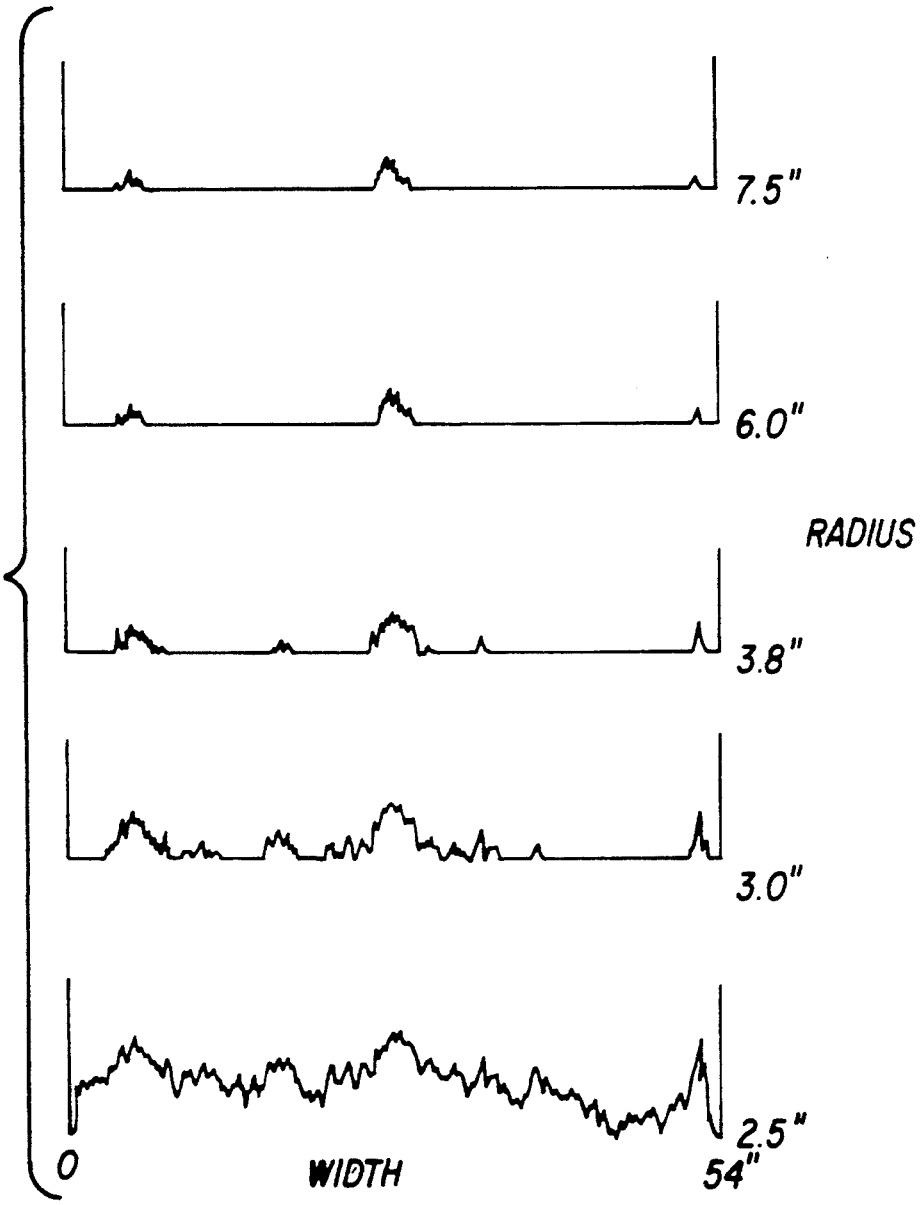
Figure 8:
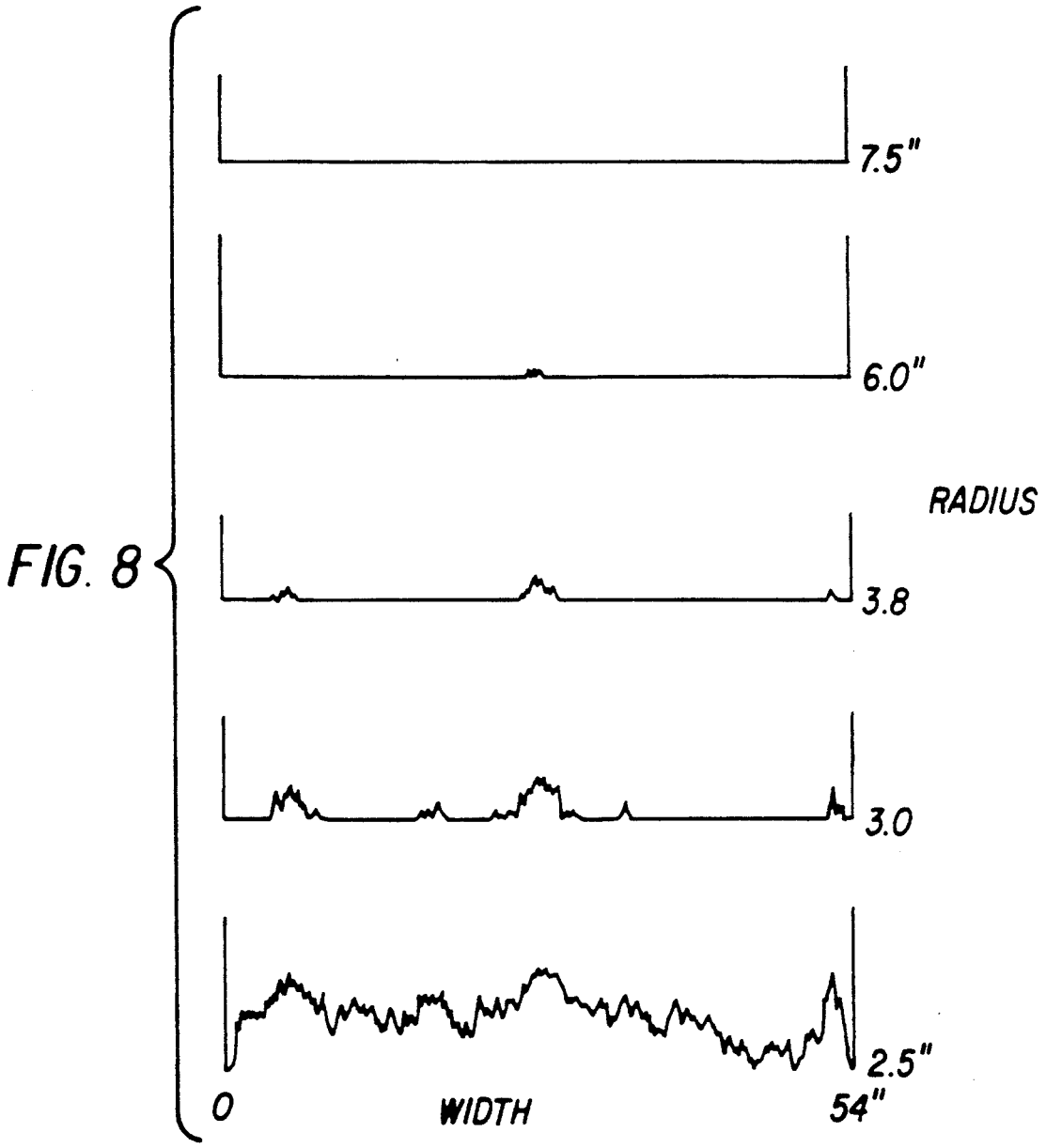

The flat portion of this plot and others in FIGS. 6–8, represent the relaxation radius, $R_o$, of the roll.

FIG. 6 plots the predicted roll profile at successive stages for a roll being wound at a lower winding tension of 110 lbs and having a knurl height as in FIG. 5, namely, 0.0073 inch. Again, as in FIG. 5, at a radius of 2.5 inches the roll has the typical surface variations exhibited in FIG. 5. As winding proceeds and the roll radius increases to 7.5 inches, (the uppermost plot), two hardstreaks, smaller than in FIG. 5, develop in the roll.

FIG. 7 is a similar series of plots for a roll being wound at 200 lbs tension but with greater knurl height, i.e., 0.0075 inch. The traces progressing from bottom to top (from a radius of 2.5 to 7.5 inches) show a steadily improving surface regularity. At 7.5 inches, the hardstreak is barely noticeable.

FIG. 8 is another series of such plots for a roll being wound at 110 lbs. tension and with a greater knurl height, i.e., 0.00075 in. Under these conditions, at 7.5 inches the roll is essentially free of hardstreaks.

Although the invention has been described specifically with reference to the winding of a melt-cast poly(ethylene terephthalate) web, it should be understood that the method can be used for controlling and reducing the formation of hardstreaks in the winding of a wide range of plastic webs. Other melt cast polymeric webs such as polyolefins are examples, as well as solventcast webs such as cellulose esters, especially cellulose triacetate.

To further illustrate the method of the invention in relating the combined imperfection severity function $\Phi$ to the predicted roll stresses and strains, consider the following example.

A particular film web product is coated with a pressure sensitive material which, when exposed to excessive pressure, suffers permanent damage and becomes useless for its intended purpose. The coating, for example, is a photographic emulsion that becomes sensitized by the excessive pressure, resulting in the production of non-imagewise optical density, i.e., not caused by light exposure, upon subsequent photographic processing.

The imperfection sensitivity function ($S_1$) for pressure (P) is described in this case by FIG. 9. In this case, the sensitivity function relates the non-imagewise optical density to the sensitizing pressure.

The example film web product is also known to be sensitive to an inroll buckling imperfection, which is known to occur in those parts of the round roll that experience negative inroll tension. The sensitivity function for this imperfection is given by FIG. 10. In this case, the sensitivity function is the probability of the buckling imperfection occurring, which is 0 for cases with positive tension and 1 for cases with negative tension.

For simplicity, it is assumed that, for this example product, all other winding imperfections are not important, and hence all other sensitivity functions are equal to 0. Accordingly, for the combined imperfection severity function in this case:

$$\Phi = \sum_{k=1}^{4} c_k\phi_k = c_1 \sum_{i=1}^{N}\sum_{j=1}^{M} S_1P(i,j) + c_2 \sum_{i=1}^{N}\sum_{j=1}^{M} S_2T(i,j)$$

where $S_1$ and $S_2$ are defined by FIGS. 9 and 10, respectively, P and T are stress distributions calculated by the previously described IRSN, and $c_1$ and $c_2$ are weight factors. The assigned values of $c_1$ and $c_2$ are based on economic considerations and reflect the relative importance of the various imperfections. For example, if it is known that the buckling imperfection is always confined to an area near the core and is easily removed in manufacturing as waste, then the relative importance, and hence the weight factor, of that imperfection is low. On the other hand, if the pressure sensitization imperfection is difficult to detect and remove before sale of the product, the relative importance and corresponding weight factor for that imperfection is high. The various economic costs considered for a particular product (material, waste, quality, etc.), determine the specific values of the weight factors.

This invention has been described in detail with particular reference to preferred embodiments thereof, but it will be understood that variations and modifications can be effected within the spirit and scope of the invention.

What is claimed is:

1. A method of winding on cores plastic webs having thickened edges which comprises:

(a) measuring properties of a web to be wound on a core including:
  (1) modulus of elasticity of the web plastic,
  (2) stackwise compression modulus of the web,
  (3) stackwise compression modulus of the thickened edges,
  (4) Poisson's ratio of the web plastic, and
  (5) stress relaxation modulus of the web plastic;

(b) measuring properties of the core, including
  (1) core modulus, and
  (2) core diameter;

(c) selecting initial winding conditions, including
(1) initial web tension,
(2) initial edge thickness, and
(3) initial web oscillation;

(d) iteratively measuring widthwise variations of said web at lengthwise locations on the web;

(e) determining the average widthwise thickness distribution for the web by averaging in the lengthwise direction the measured widthwise thickness variations;

(f) determining the combined imperfection severity function from the measurement of said properties of the web and the core, said initial winding conditions, and said average widthwise thickness distribution by means of the following relationship $$\Phi = \sum_{k=1}^{4} c_k \phi_k$$

wherein $\Phi$ is the combined imperfection severity function, $\phi_k$ is the kth individual imperfection severity function, and $c_k$ is the weight factor for the kth individual imperfection severity function;

(g) comparing the value of the combined imperfection severity function so determined with a preestablished tolerance to determine whether said value of the combined imperfection severity function is within or outside the tolerance;

(h) when said value of the combined imperfection severity function is within said tolerance, winding the web on the core at said initial winding conditions;

(i) when said value of the combined imperfection severity function is outside said tolerance, winding the web on the core under winding conditions corrected by adjustment of at least one of the conditions of web tension, edge thickness, and web oscillation to cause optimization of the value of said combined imperfection severity function.

2. The method of claim 1 which comprises winding a second web at initial winding conditions corresponding to said corrected winding conditions.

3. The method of claim 1 which comprises winding a second web at winding conditions that were computed from the measurements collected on winding said web, the core used for winding the second web having the same properties as the core used for winding said web.

* * * * *